United States Patent [19]

Gibbs

[11] Patent Number: 5,050,142

[45] Date of Patent: Sep. 17, 1991

[54] PILL TAKER'S WRIST WATCH WITH TWO TEMPERATURE SENSORS

[76] Inventor: John H. Gibbs, 333 S. Clay St., Mooresville, Ind. 46158

[21] Appl. No.: 516,903

[22] Filed: Apr. 30, 1990

[51] Int. Cl.[5] ..... G04B 47/06

[52] U.S. Cl. ..... 368/11; 368/281

[58] Field of Search ..... 368/12, 10, 11, 243-269, 368/281-283

[56] References Cited

U.S. PATENT DOCUMENTS 3,937,004 2/1976 Natori et al. ..... 368/11

4,236,236 11/1980 Jaunin ..... 368/11

*Primary Examiner*—Bernard Roskoski

[57] ABSTRACT

A wrist watch with an sound alarm is used for pill takers. The wrist watch is a standard wrist watch (displays time and date) except for two temperature sensors (one on the bottom and the other on the top). These temperture sensors prove when an owner is wearing the wrist watch. A pill taker can make a schedule of alarms based on when he/she wakes up, when they go to sleep, relative time (from when they wake up or go to sleep) or absolute time of day and date.

1 Claim, 2 Drawing Sheets

PILL TAKER'S WRIST WATCH WITH TWO TEMPERATURE SENSORS

BACKGROUND OF THE INVENTION

The present invention relates to alarm wrist watches that will warn individuals of when to take medication and more specifically, wrist watches that know when it's being worn by the individual.

A few related devices of this nature have been provided in prior art that are wrist watches (electronic timepieces), medication timers, pill bottle timer and medicine cabinets. Examples of wrist watches are U.S. Pat. Nos. 4,896,306; 4,774,697; 4,652,140; 4,472,069; 4,427,299; 4,386,856 and 4,384,790. Examples of medication timers are U.S. Pat. Nos. 4,682,299; 4,588,303 and 4,483,626. Examples of Pill Bottle timers are U.S. Pat. Nos. 4,768,176; 4,448,541; 4,419,016; 4,405,045; 4,367,955 and 4,361,408. Examples of Medicine Cabinets are U.S. Pat. Nos. 4,663,621; 4,626,105; 4,382,688; 4,275,384 and 4,207,992. While these units may be suitable for the particular purpose to which they address, they would not be as suitable for the purposes of the present invention as heretofore described.

SUMMARY OF INVENTION

The present state of invention is an alarm wrist watch for people who have to take pills on a regular schedule. This wrist watch has a sound generator that signals the owner when to take a pill. The pill schedule is programmed into the wrist watch by the owner. The unique feature about this watch is the two temperature sensors(one on top and the other on bottom). These sensors are used to determine whether an individual is wearing the wrist watch or not. This feature allows the owner to take their pills when they wake up or go to sleep.

BRIEF DESCRIPTION OF THE DRAWING FIGURES

DETAILED DESCRIPTION OF THE PREFERRED EMBODIMENT

Figure 1A:
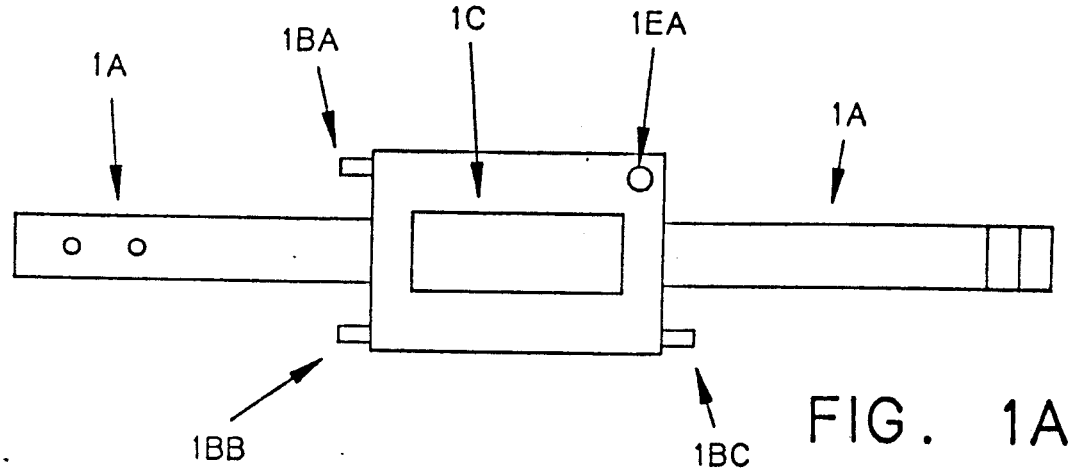
FIG. 1A shows the top side of the wrist watch.

FIG. 1A shows the top view of the wrist watch 1 for pill takers. The wrist band 1A holds the watch 1 on the owner's wrist. The function keys 1B is composed of three buttons or keys 1BA, 1BB and 1BC. The "A" key 1BA can turn on a small light for seeing the LCD display 1C at night. It can also advance a digit set (day of month, day of week, am or pm, hour, minute or second) count on the display 1C when its in the reset mode. The "B" key 1BB is responsible for mode selection (normal, reset timer or reset alarm). The "C" Key 1BC can advance the selection of which digit set is to be changed on the display 1C. The LCD display 1C shows important displays like time display (day of month, day of week, hour, minute and second) and pill alarm setting.

Figure 1B:
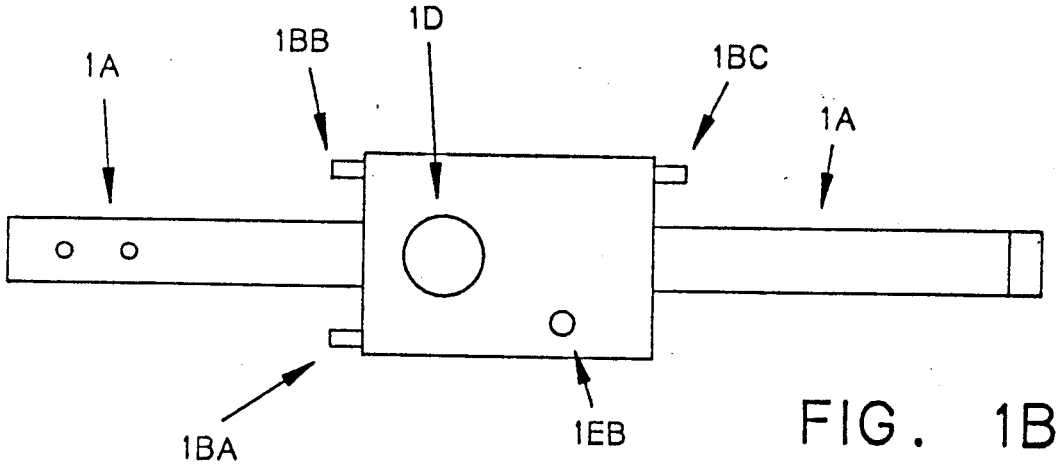
FIG. 1B shows the bottom side of the wrist watch.

FIG. 1B shows the back side (or bottom side) of the wrist watch 1. The wrist band 1A and function keys 1BA, 1BB and 1BC are the same as in FIG. 1A. The battery cover 1D can be removed to replace the batteries (which are not shown in any diagram). The heat sensors 1E is used so the watch's integrated circuit 2A knows the watch is on the owner's wrist. The watch has 2 heat sensors 1E, one is on the top side (face side) 1EA and the other is on the bottom side 1EB.

Figure 2:
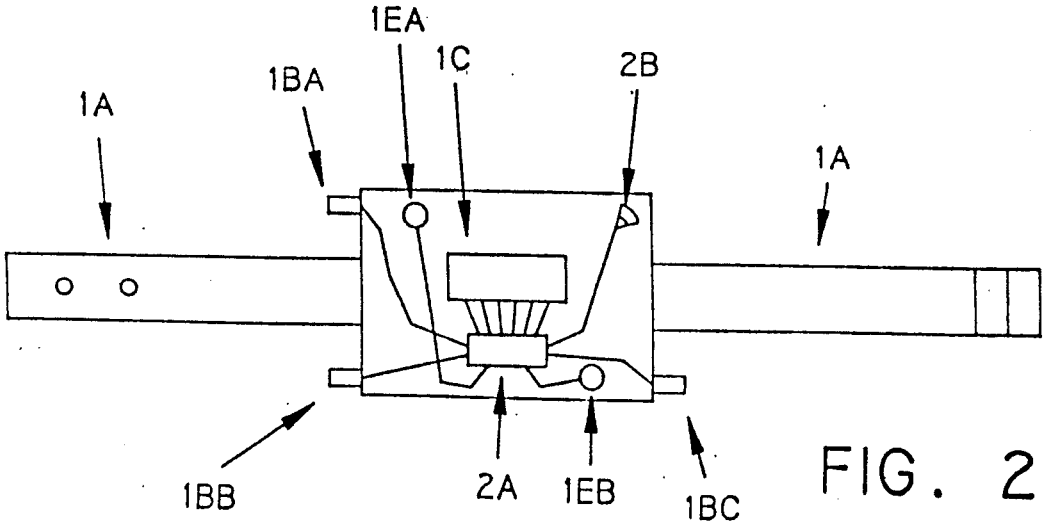
FIG. 2 illustrates the inside view of the wrist watch.

FIG. 2 illustrates the insides of the wrist watch 1. The watch has the standard outside features of wrist band 1A, function keys 1BA, 1BB and 1BC, the LCD display 1C and the heat sensors 1E. There is a sound output transducer 2B that emits an audible sound. The voltage from the heat sensors 1E is analog.

The heart of the watch is the integrated circuit 2A. The circuit 2A is a all purpose timer and microprocessor that contains small amounts of RAM and ROM and possible some analog to digital convertors or schmitt triggers (this is for the heat sensors). The integrated circuit 2A has inputs of the function keys 1B and the heat sensor 1E. The outputs of the circuit 2A are the LCD display 1C and the sound output 2B.

Figure 3:
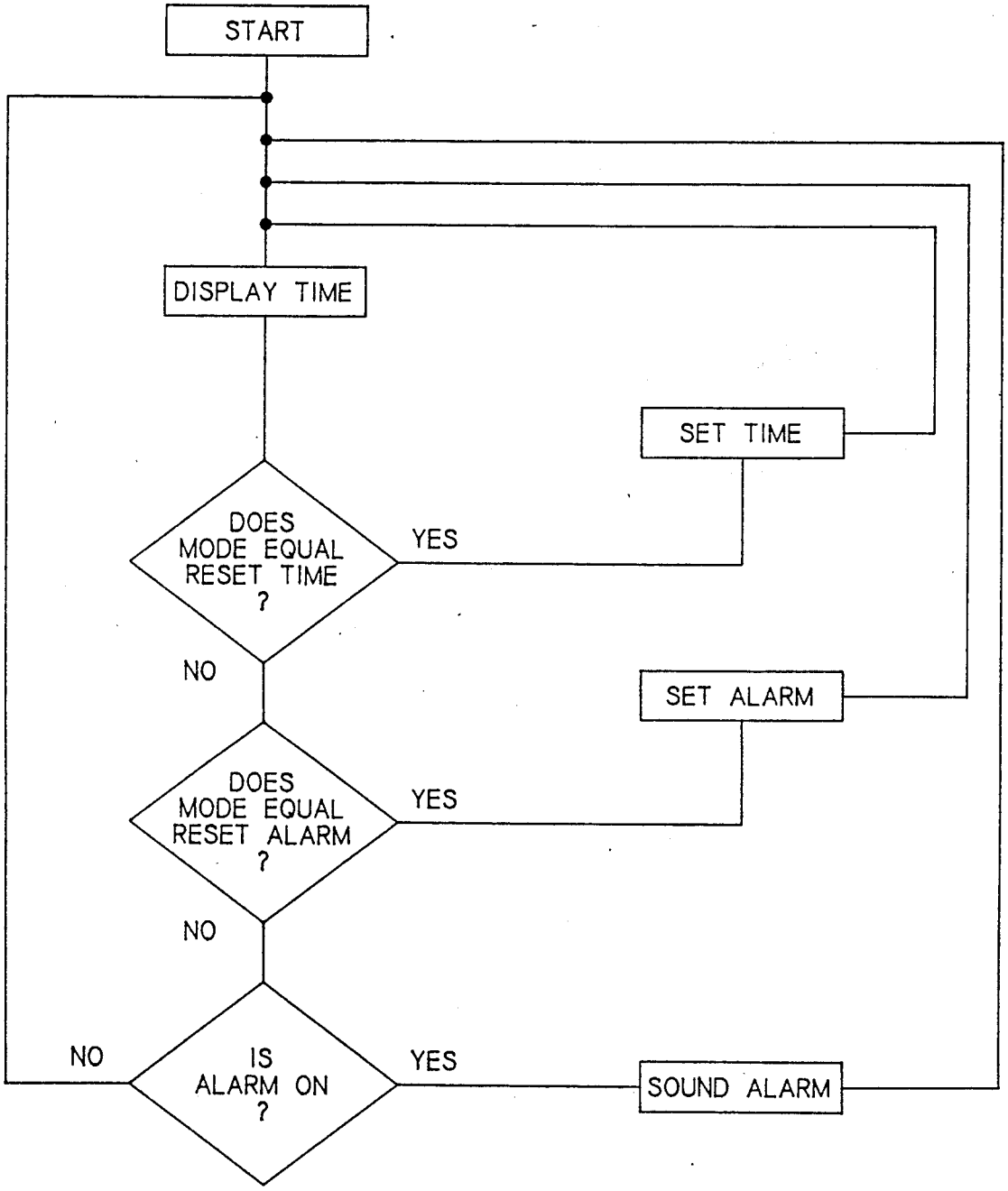
FIG. 3 shows the flow chart of the wrist watch's microprocessor.

FIG. 3 illustrates the flow chart for the integrated circuit's microprocessor 2A. The most important process is to control the LCD display 1C showing current time. Inbetween a second (of time) the processor asks the question "Does the mode equal reset time?" This means the function key 1BB was pressed to RESET TIME mode. If it was then activate subroutine "SET TIME". Else loop back to display time. The next most asked question is "Does the mode equal RESET ALARM?" This means the function key 1BB was pressed to SET ALARM mode. If it was then activate subroutine "SET ALARM" Else loop back to display time. This subroutine isn't a standard alarm. There are several possible alarms. Each alarm can be set at a specific time of the year or peroidic times of the years (every day or week etc) or it can be set at a small time after a person puts on or takes off their wrist watch (morning or night).

The last question asked by the controlling program is "Is the alarm ON?" This means "Has a specific alarm reached a designated time?" or "Has the heat sensor changed?" If the alarm is ON then activate the subroutine SOUND ALARM. Else loop back to display time.

In the normal operation procedure, a owner gets up in the morning and gets ready. They put on their watch in the process. The heat of their body warms up the heat sensor on the watch. If the alarm was set for morning pill, the owner will hear an alarm (say 5 mins after the watch is on). During the day, an alarm can depend on the time of day or a time after they wake up. The morning activation of the heat sensor is restricted to the first wearing of the watch. The firstness is determined by a period of rest (nighttime). The heat sensor generally knows the difference between hot weather and body temperature. The difference between the top heat sensor 1EA and the bottom heat sensor 1EB can prove the difference between ambient temperature and body temperature. Also taking the watch off and on (temporarly) will not cause changing the alarms.

At night, an owner takes off their watch. If an alarm was set for the owner to take a pill then the watch sounds an alarm. When the watch is taken off, how does the processor know it's the last time of the day (and to sound the alarm)? If the time at which the watch was taken off was after a specific time (eg 6:00 pm) then it is designated as the last occurance of taking the watch off.

One final point, the heat sensor 1EB can be used for biofeedback with patients who have hypertension and high blood pressure.

What is claimed is:

1. An electronic digital wrist watch for people who have to take pills on a regular schedule, comprising a case having a front and back;

display means for showing time, date, and alarm programming;

key button means for controlling time, date, and alarm programming;

two temperature sensor means each having an output, one of said temperature means is located near the on top of the watch and the other of said sensor is near the bottom of said watch such that the top sensor will sense the temperature near the top and the bottom sensor will sense the temperature near the bottom, whereby the differences in outputs determines whether one is wearing the watch;

an audible sound generator for producing audible sound;

electronic means responsive to said key means for controlling said display means and in response to said sensor outputs and a set time for controlling said sound generator;

whereby an alarm or reminder can be sounded based on whether one is wearing the watch or not.

* * * * *